US011239539B1

(12) United States Patent
Burdick et al.

(10) Patent No.: US 11,239,539 B1
(45) Date of Patent: Feb. 1, 2022

(54) SUBSTRATE-MOUNTABLE ELECTROMAGNETIC WAVEGUIDE

(71) Applicant: Knowles Cazenovia, Inc., Cazenovia, NY (US)

(72) Inventors: Jared Burdick, Fayetteville, NY (US); Pierre Nadeau, Cazenovia, NY (US)

(73) Assignee: Knowles Cazenovia, Inc., Cazenovia, NY (US)

( * ) Notice: Subject to any disclaimer, the term of this patent is extended or adjusted under 35 U.S.C. 154(b) by 0 days.

(21) Appl. No.: 17/013,504

(22) Filed: Sep. 4, 2020

(51) Int. Cl.
*H01P 3/16* (2006.01)
*H01P 3/12* (2006.01)
*H01P 5/08* (2006.01)

(52) U.S. Cl.
CPC ..... *H01P 3/16* (2013.01); *H01P 3/122* (2013.01); *H01P 5/087* (2013.01)

(58) Field of Classification Search
CPC .... H01P 3/16; H01P 3/122; H01P 3/00; H01P 5/08; H01P 5/00; H01P 5/02; H01P 5/087; H01P 5/107; H01P 5/103; H01P 1/2002
USPC ..... 333/208, 239, 248
See application file for complete search history.

(56) References Cited

U.S. PATENT DOCUMENTS 6,020,800 A * 2/2000 Arakawa ..... H01P 7/04 333/208
7,449,980 B2 11/2008 Bates
7,663,454 B2 2/2010 Bates
7,956,708 B2 6/2011 Bates
9,490,768 B2 11/2016 Randall
9,853,339 B2 * 12/2017 Yatabe ..... H01P 5/087
10,547,096 B2 1/2020 Bates
10,770,776 B2 9/2020 Bates
2020/0021030 A1 1/2020 Bates
2020/0259263 A1 8/2020 Dani
2020/0358160 A1 11/2020 Alton
2020/0403286 A1 12/2020 Burdick

OTHER PUBLICATIONS

Nadeau, U.S. Appl. No. 16/699,187, U.S. Patent and Trademark Office, filed Nov. 29, 2019.

* cited by examiner

*Primary Examiner* — Stephen E. Jones
(74) *Attorney, Agent, or Firm* — Loppnow & Chapa; Matthew C. Loppnow; Roland K. Bowler, II

(57) ABSTRACT

An electromagnetic waveguide including conductive material on upper lower, and side surfaces of a dielectric is disclosed. A conductive excitation member is electrically coupled to the conductive material on the upper surface of the dielectric and extends to the lower surface of the dielectric at or near an end surface of the dielectric. The conductive excitation member includes a host interface flange separated and electrically isolated from the conductive material on the lower surface of the dielectric. The conductive material on the lower surface of the dielectric can be a ground plane and the waveguide can be a surface-mountable component.

20 Claims, 6 Drawing Sheets

SUBSTRATE-MOUNTABLE ELECTROMAGNETIC WAVEGUIDE

TECHNICAL FIELD

The disclosure relates generally to electromagnetic waveguides and more particularly to dielectric waveguide components that are mountable on a substrate.

BACKGROUND

Electromagnetic waveguides generally comprise a metallized conduit that defines boundaries within which the propagation of energy is constrained. Dielectric filled waveguides are often used for higher frequency applications, like microwaves. The geometry of the waveguide affects characteristics of the waveguide like impedance, cutoff frequency and propagation mode. Waveguides can be configured as couplers, polarizers, and filters among other circuit elements in small-scale radio frequency (RF) and microwave systems. These and other waveguide systems often require mounting of a waveguide component on a printed circuit board (PCB) for transitioning to coplanar, microstrip, stripline or other impedance controlled transmission lines. To facilitate such integration, micros trip transmission lines sometimes include a widening apron that forms a transition for interfacing with the waveguide. It's also known to provide a tapered spacing between conductive posts in substrate integrated waveguides (SIW) to form a narrowing transition for interfacing with a coplanar transmission line. The transition interface between waveguide components and impedance controlled transmission lines however tends to be a source of impedance mismatch or reduced bandwidth and may require increased component size.

The objects, features and advantages of the present disclosure will become more fully apparent to those of ordinary skill in the art upon careful consideration of the following Detailed Description and the appended claims in conjunction with the accompanying drawings described below.

DETAILED DESCRIPTION

The present disclosure relates generally to electromagnetic waveguides mountable on a substrate like a printed circuit board (PCB) as described further herein. Such waveguides can be configured as a coupler, a polarizer, resonator, or filter among other electrical components for use in small-scale radio frequency (RF) systems or subassemblies. The term "radio frequency" as used herein includes microwaves.

The waveguide generally comprises a dielectric substrate, also referred to herein as a dielectric, having at least partially conductive portions that define boundaries within which propagating radio frequency energy is confined. The dielectric can comprise a ceramic, glass, or plastic among other materials and compositions having suitable permittivity and other characteristics. The conductive portions can be metallized surfaces of the dielectric substrate formed by selectively applying metal or other conductive material on portions of the dielectric substrate. The metal can be a base metal, precious metal, metal alloy or some other conductive material. Metals can be applied by sputtering, plating or other known or future deposition processes. The conductive material can also be conductive sheet material layered onto the dielectric.

Characteristics of the waveguide depend on its geometry as well as dielectric material properties. For example the cutoff frequency is a function of spacing between the side conductors, i.e., a width of the waveguide, dielectric constant of the substrate material, and impedance is a function of the spacing or height between the conductors on the upper and lower surfaces of the waveguide.

Figure 1:
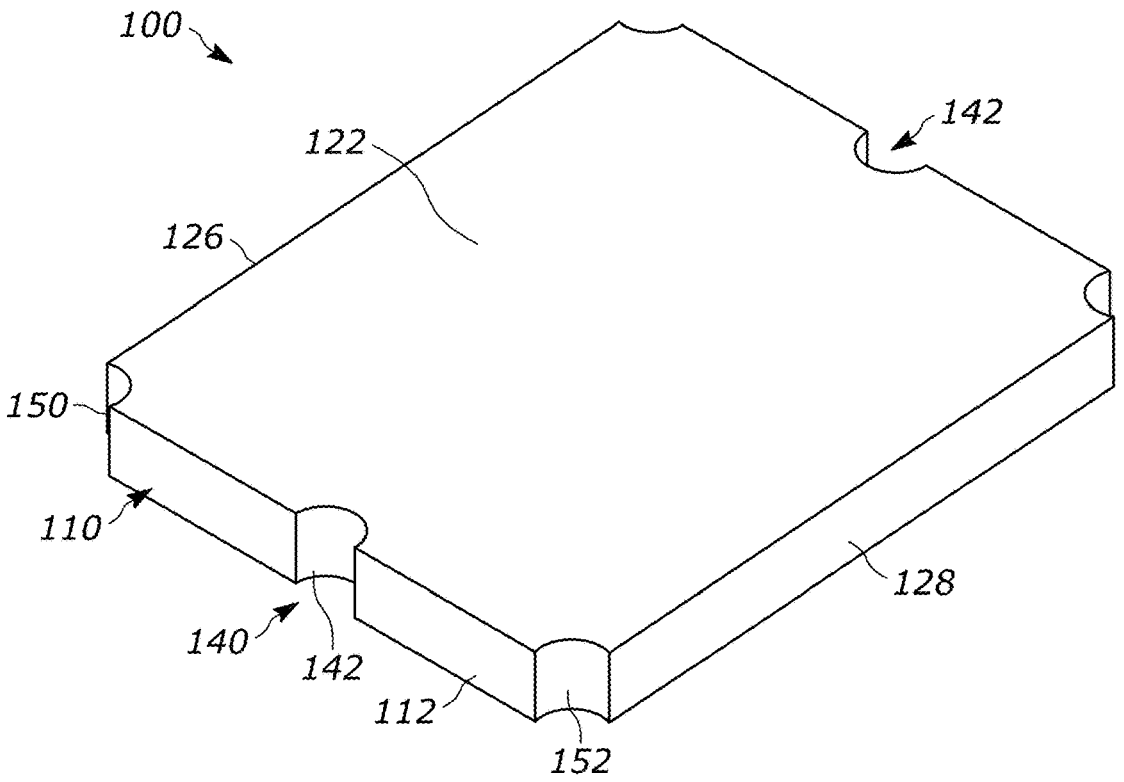
FIG. 1 is a top perspective view of a waveguide.
Figure 2:
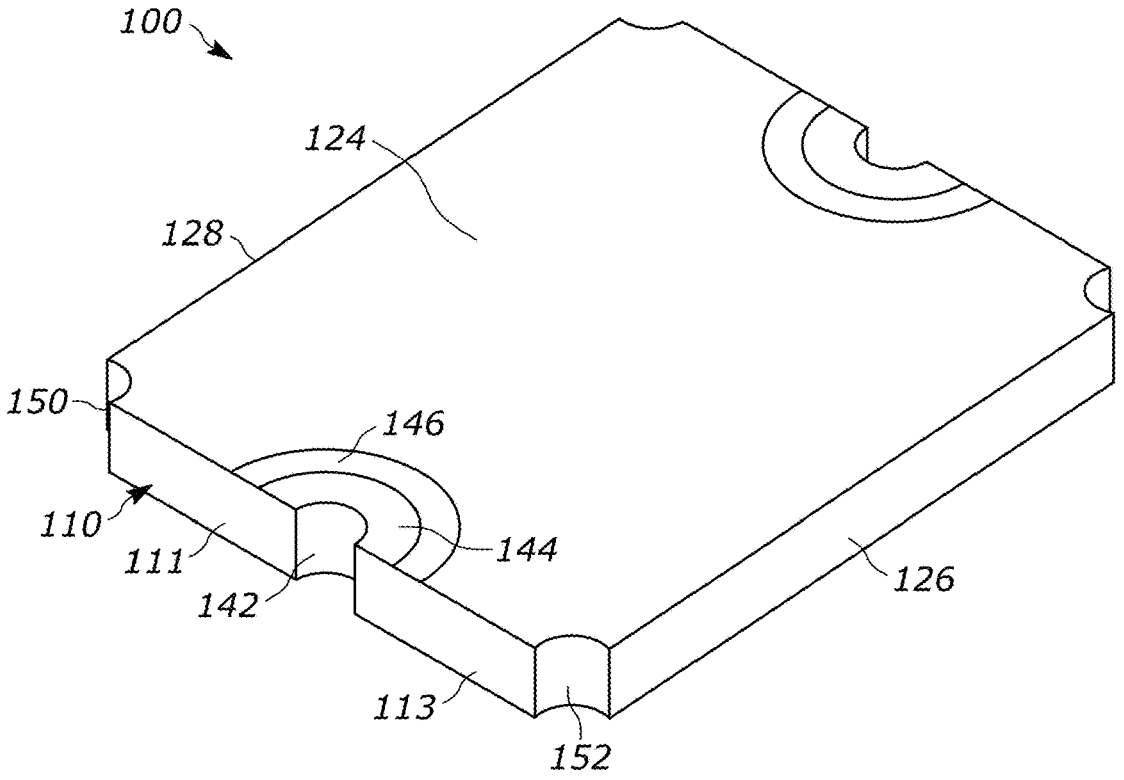
FIG. 2 is a bottom perspective view of the waveguide in FIG. 1.
Figure 8:
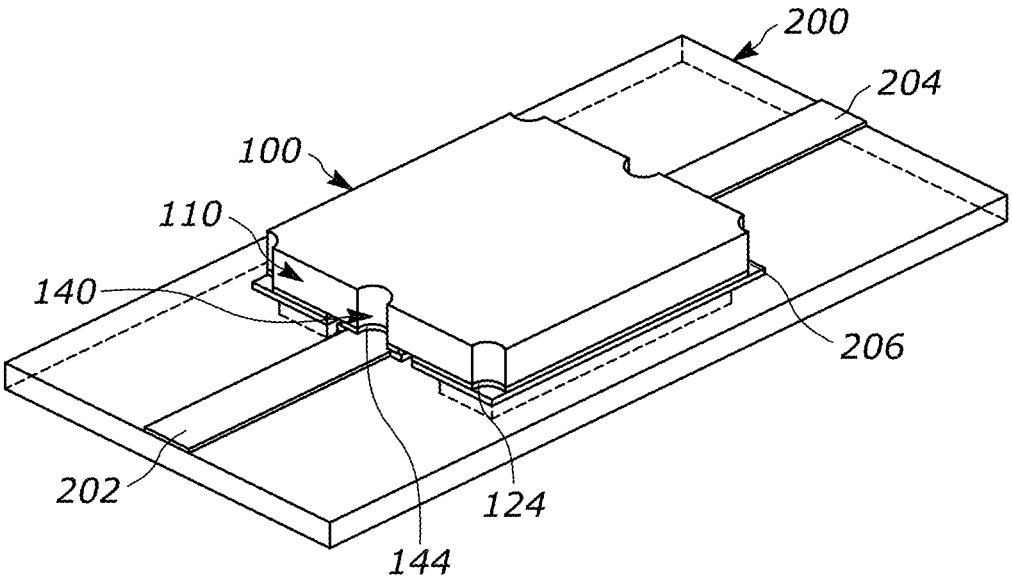
FIG. 8 is a perspective view of a waveguide mounted on a host device.

One such waveguide is a transverse electric (TE) mode waveguide. In FIGS. 1, 2 and 8, a rectangular waveguide 100 comprises a dielectric 110 having a cuboid shape. More generally however the dielectric substrate and hence the waveguide can have other shapes, like cubic or cylindrical shapes. One of the conductive surfaces of the waveguide can be a ground plane mountable on a printed circuit board (PCB) of a host device as described herein.

In FIG. 1, the waveguide comprises a conductor 122 adjacent a top surface of the dielectric 110. In FIG. 2, the waveguide includes a conductor 124 adjacent a bottom surface of the dielectric 110. In some implementations, the conductor 124 is a ground plane. Generally, the conductor 122 is electrically coupled to the conductor 124 by a first side conductor adjacent a first side surface portion of the dielectric and by a second side conductor adjacent a second side surface portion of the dielectric. In other implementations, the conductors 122 and 124 can have other shapes or structures, e.g., metallic screens among others, to constrain the radio frequency energy.

Figure 3:
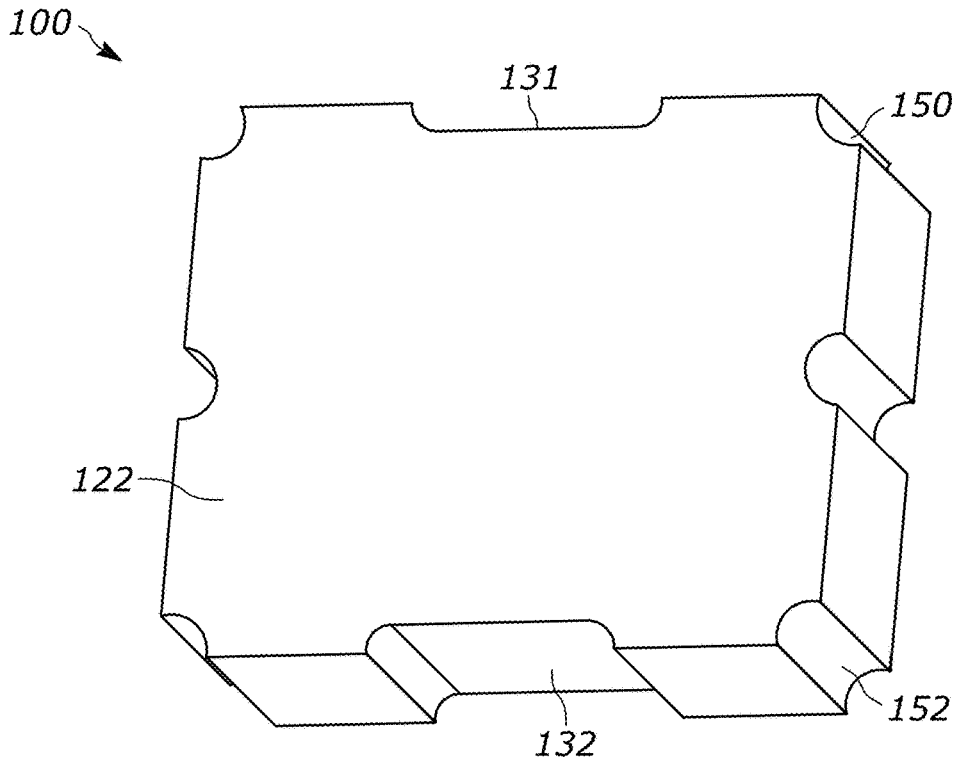
FIGS. 3-7 show various waveguide implementations.
Figure 4:
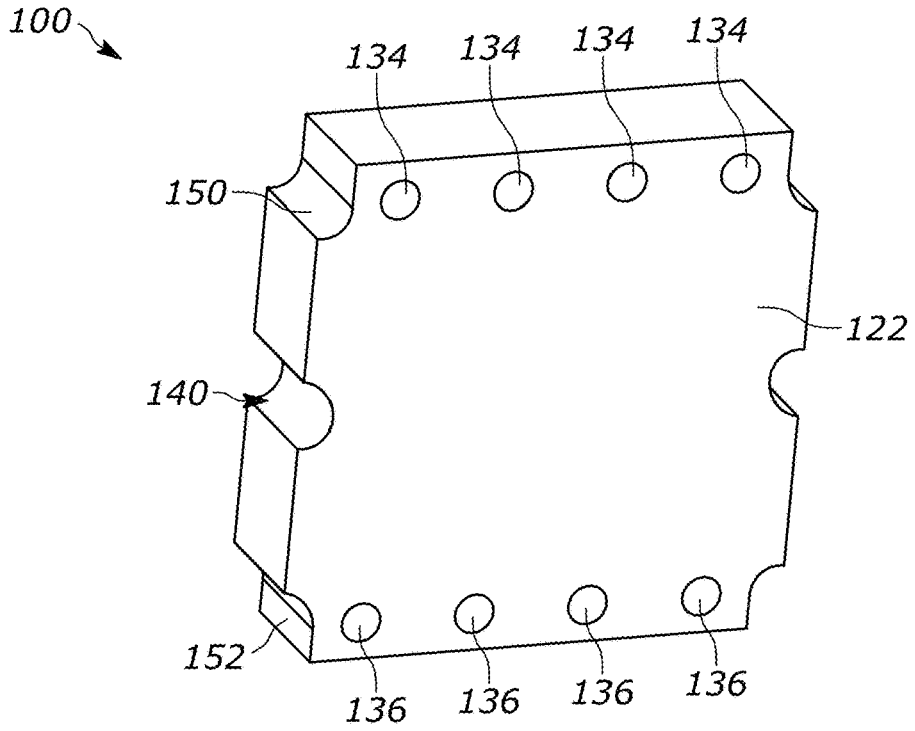
Figure 5:
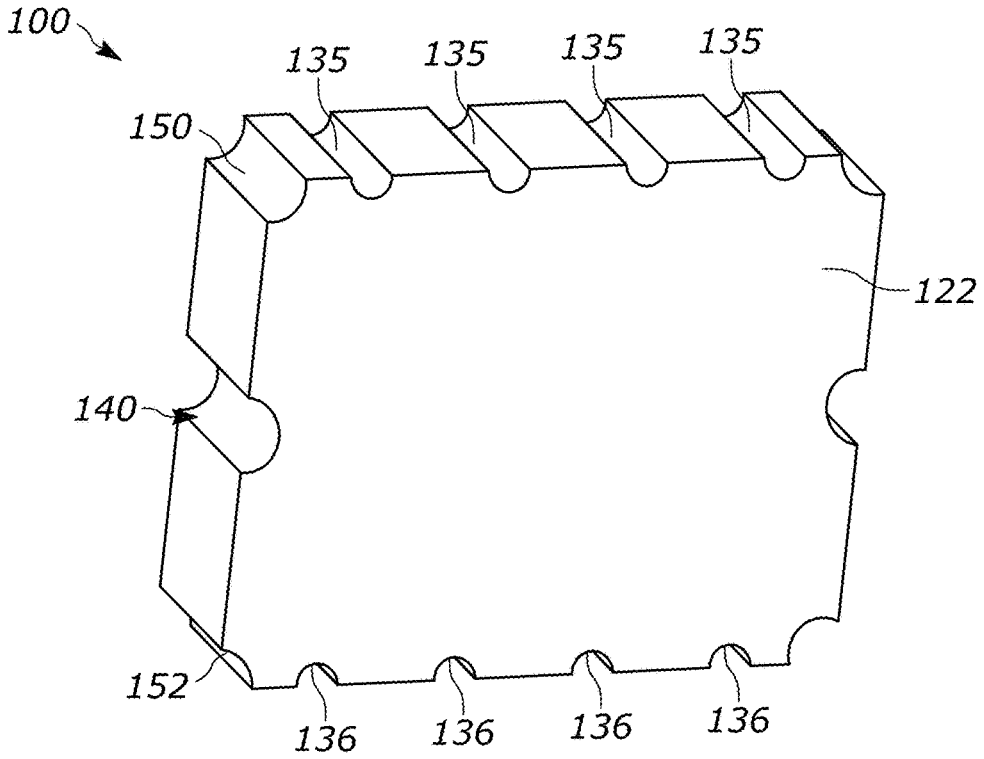
Figure 6:
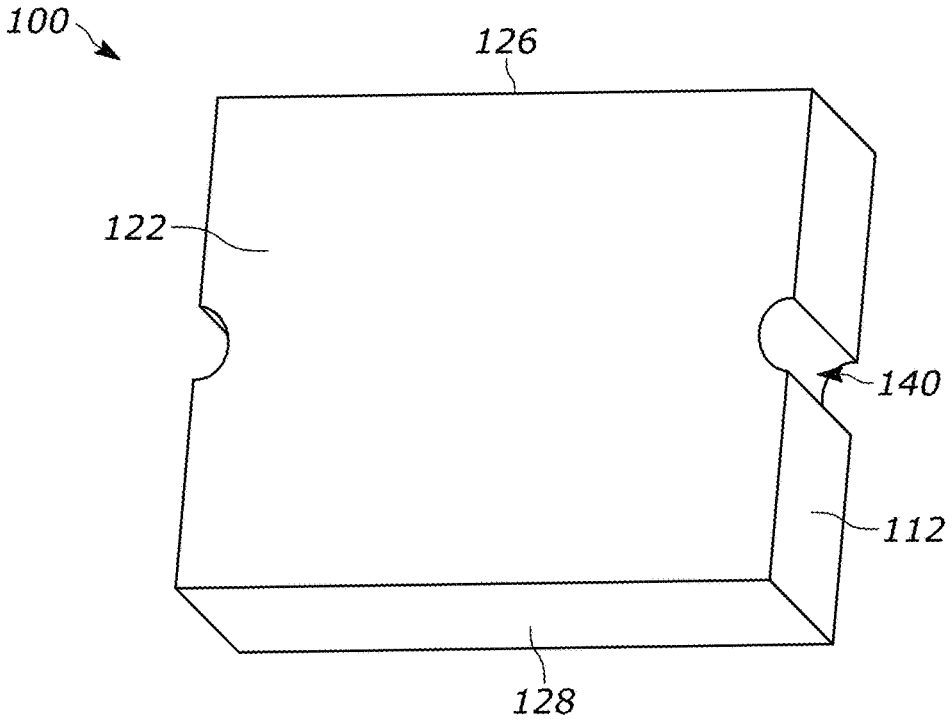

The first and second side conductors of the waveguide can be implemented in any one of many different forms. In FIGS. 1, 2 and 6, the first and second side conductors are metallized surfaces 126 and 128 disposed on and covering substantially all of the outer surfaces of corresponding side wall portions of the dielectric. The conductive surfaces 126 and 128 interconnect the conductor 122 and the ground plane 124. In other implementations, however, the first and second side conductors do not cover the entire side wall portions of the dielectric. In FIG. 3, the first and second side conductors each comprise a metallized slot 131 and 132 disposed on outer surface portions of corresponding dielectric side walls. The conductive slots 131 and 132 interconnect the conductor 122 and the ground plane. In FIG. 4, the first and second side conductors comprise a corresponding plurality of metallized cylindrical vias 133 and 134 extending through openings in the dielectric adjacent corresponding side walls of the dielectric. The conductive vias 133 and 134 interconnect the conductors on the upper and lower surfaces of the dielectric. In FIG. 5, the first and second side conductors comprise a corresponding plurality of metallized semi-cylindrical castellations 135 and 136 formed on an outer surface of the dielectric side walls. The conductive castellations 135 and 136 interconnect the conductors on the upper and lower surface of the dielectric. In other implementations, the first and second side conductors can be other than sheet like conductors to constrain radio frequency energy. For example, the conductive materials can be implemented as metallic screens, or meshes or other structures.

The waveguide also comprises a conductive excitation member at one or both ends thereof. In some implementations, the signal is introduced at an input of the waveguide and extracted at an output of the waveguide. Generally, the excitation member is electrically coupled to the conductor and is disposed through or across a portion of the dielectric at or near an end surface of the dielectric that is devoid of conductive material, wherein portions of the end surface, on opposite sides of the conductive excitation member, are devoid of conductive material. The excitation member also includes a host interface electrically isolated from the ground plane and connectable to a transmission line on a host device.

In FIGS. 1 and 2, a conductive excitation member 140 is electrically coupled to the conductor 122 and includes a semi-cylindrical shaped castellation 142 disposed across the first end surface portion 112 of the dielectric. In other embodiments, the castellation 142 can have other shapes and need not be located on the end surface of the dielectric. For example, the castellation can have a cylindrical shape and be located in an opening through the dielectric spaced inwardly from the end surface 112. FIG. 2 shows dielectric portions 111 and 113 on opposite sides of the excitation member 140 devoid of conductive material. In FIG. 2, the excitation member 140 includes a host interface embodied as a flange 144 extending therefrom for integration with the host. The host interface flange is separated and electrically isolated from the ground plane 124 by a dielectric portion 146. An impedance of the transition is a function of the gap exposing the dielectric portion 146 between the outermost portion of the host interface flange 144 and the ground plane 124. In FIG. 2, the host interface flange 144 is coplanar with the ground plane 124. In other implementations however the host interface can have other shapes and spatial orientations and configurations to accommodate a complementary non-planar interface on a host device.

Figure 7:
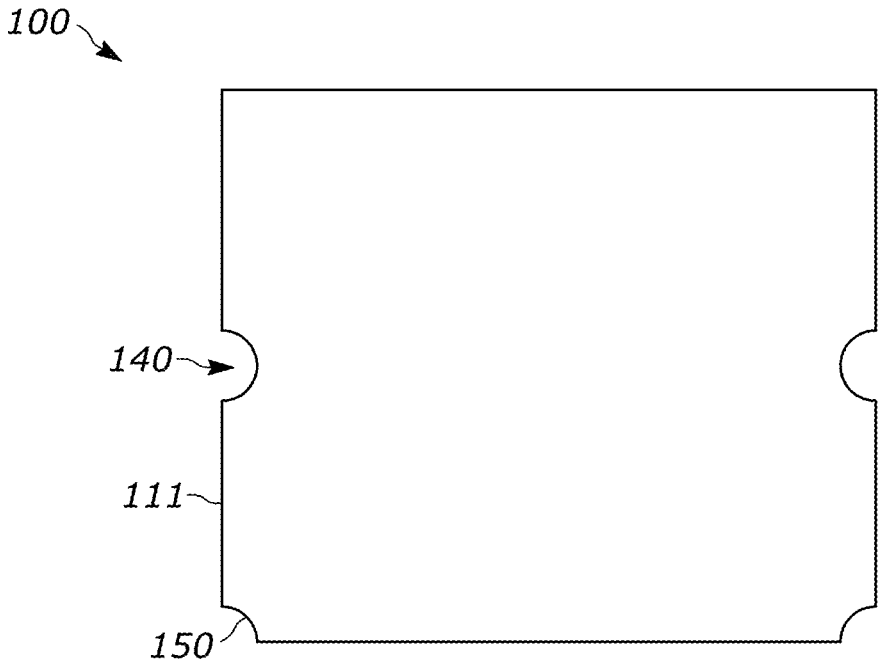

In some implementations, the waveguide includes one or more lateral conductors interconnecting the conductive member and the ground plane. The one or more lateral conductors are disposed on or near the same end surface portion of the dielectric where the conductive excitation member is located, wherein at least a portion of the first end surface portion of the dielectric is devoid of conductive material between the one or more lateral conductors and the conductive excitation member. An input impedance of the waveguide is a function of the one or more lateral conductors and the size of the excitation member. In implementations including first and second lateral conductor, the conductive excitation member can be located between the first and second lateral conductors. In FIGS. 1-5, the waveguide includes lateral conductive material 150 and 152 disposed on corresponding corners of the waveguide. In FIG. 6, the lateral conductive material corresponds to conductive material 126 and 128 on the side surfaces of the dielectric, wherein the end surface portion 112 of the dielectric is devoid of conductive material. In FIG. 7, the waveguide includes only a single lateral conductive member or material 150 disposed on a corner of the waveguide. In the illustrated embodiments, the lateral conductive material is disposed on an outer surface of the dielectric. In other embodiments, however, the lateral conductive materials may be castellations formed in or on through-holes located inwardly of an outermost surface or surfaces of the dielectric.

Figure 9:
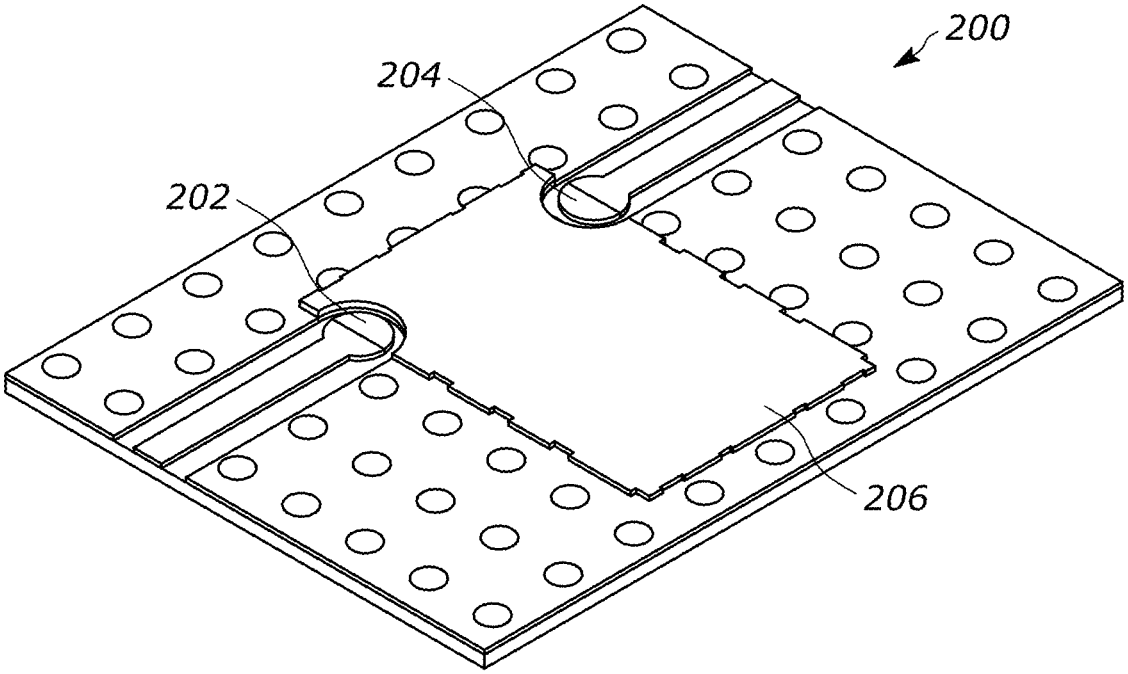
FIG. 9 is a perspective view of a portion of a host device.

In FIG. 8, a waveguide 100 is mounted on a substrate 200, which may be a printed circuit board (PCB) or other component of a host device or subassembly. FIGS. 8 and 9 show a PCB substrate comprising conductive transmission line portions 202 and 204 and ground plane 206 formed thereon. The transmission line can be a micros trip, stripline, coplanar waveguide trace or other transmission structure. The conductive excitation members of the waveguide are electrically coupled to corresponding transmission lines and the ground plane of the waveguide is electrically coupled to the ground plane of the substrate. In FIG. 8, the conductive excitation member 140 and particularly the host interface flange 144 thereof is electrically coupled to the transmission line 202. The ground plane 124 on the underside of the waveguide is shown coupled to the ground plane 206 of the substrate. The waveguide is a surface-mount component that can be mounted on the substrate by reflow soldering or other known or future affixation processes. Alternatively, the ground plane 124 can have though-hole contacts that are disposed in, and soldered to, corresponding openings in the substrate.

Figure 10:
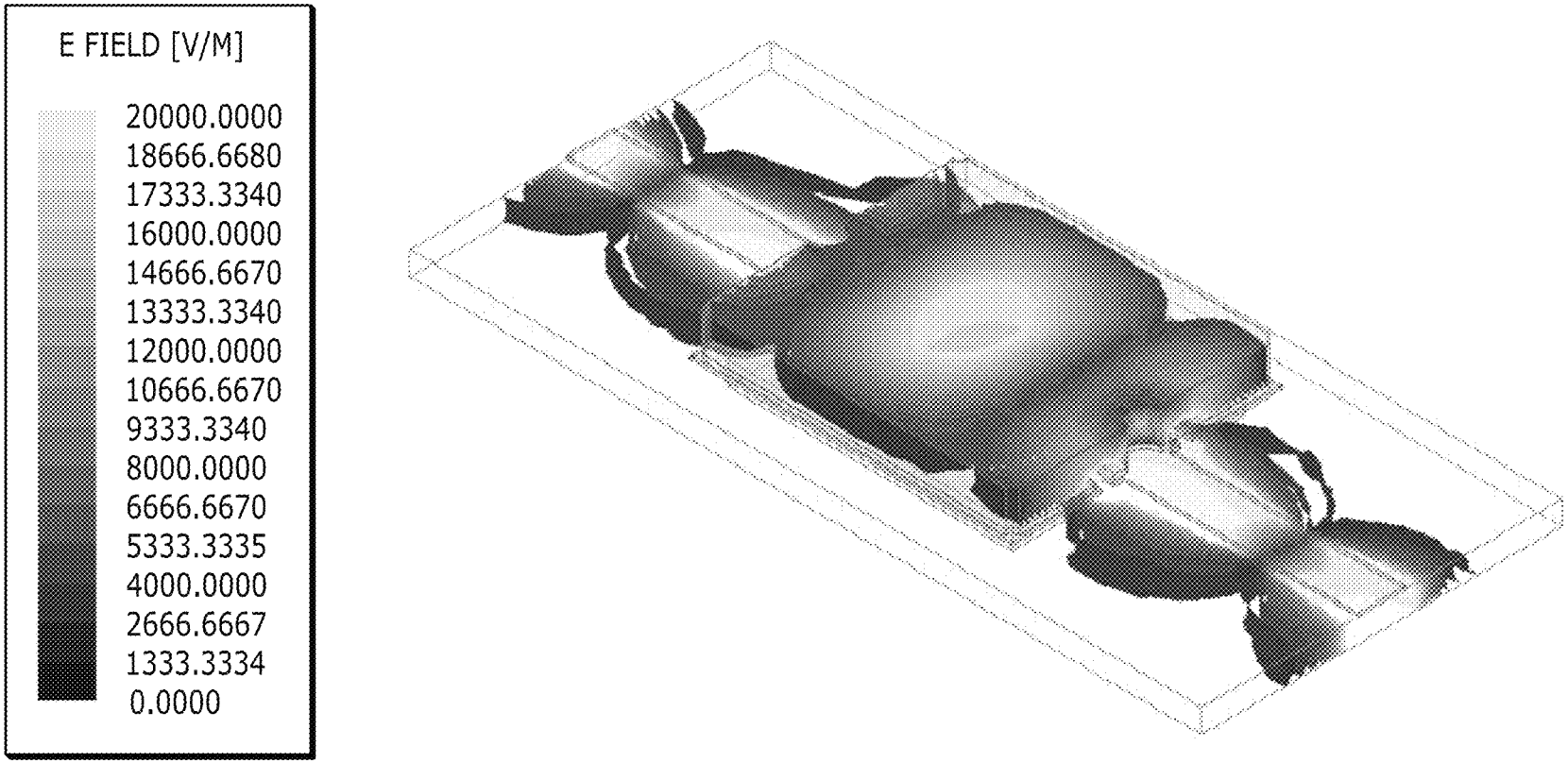
FIG. 10 illustrates electric field strength of a waveguide mounted on a host device.

FIG. 10 illustrates the magnitude of the TE mode electric field inside of a rectangular waveguide mounted on a host substrate with micros trip transmission line feeds.

While the present disclosure and what is presently considered to be the best mode thereof has been described in a manner establishing possession by the inventors and enabling those of ordinary skill in the art to make and use the same, it will be understood and appreciated that equivalents of the exemplary embodiments disclosed herein exist, and that myriad modifications and variations may be made thereto, within the scope and spirit of the disclosure, which is to be limited not by the exemplary embodiments described but by the appended claims.

What is claimed is:

1. An electromagnetic waveguide comprising:

a dielectric;

a conductive material adjacent upper, lower and opposite side surfaces of the dielectric, a first end surface of the dielectric devoid of the conductive material;

a first conductive excitation member electrically coupled to the conductive material on the upper surface of the dielectric and extending to the lower surface of the dielectric at or near the first end surface of the dielectric, the first conductive excitation member having a first host interface, the first host interface separated and electrically isolated from the conductive material adjacent the lower surface of the dielectric.

2. The waveguide of claim 1 further comprising:

a second conductive excitation member electrically coupled to the conductive material on the upper surface of the dielectric and extending to the lower surface of the dielectric at or near a second end surface of the dielectric devoid of conductive material, the second conductive excitation member having a second host interface, the second host interface separated and electrically isolated from the conductive material adjacent the lower surface of the dielectric.

3. The waveguide of claim 1 is a surface-mount component and the conductive material on the lower surface of the dielectric is a ground plane.

4. The waveguide of claim 3, wherein the first host interface is substantially coplanar with the ground plane.

5. The waveguide of claim 4, wherein the first host interface is a flange extending from the first conductive excitation member, the first host interface flange spaced apart from the ground plane.

6. The waveguide of claim 1 is a transverse electric (TE) mode waveguide.

7. The waveguide of claim 6, the conductive material adjacent a first side surface of the dielectric interconnecting the conductive material on the upper and lower surfaces of the dielectric, and the conductive material adjacent a second side surface of the dielectric interconnecting the conductive material adjacent the upper and lower surfaces of the dielectric, the end surface of the dielectric located between the first and second side surfaces of the dielectric.

8. The waveguide of claim 7, the conductive material on the first and second side surfaces of the dielectric comprising any one or more of a metallized slot, a metallized via, a metallized surface, or a metallized castellation.

9. The waveguide of claim 6 further comprising a first lateral conductive material interconnecting the conductive materials adjacent the upper and lower surfaces of the dielectric, the first lateral conductive material disposed on or near the first end surface of the dielectric.

10. The waveguide of claim 9, wherein the first lateral conductive material is disposed on a first corner of the dielectric, the first corner between the first end surface and one of the side surfaces of the dielectric.

11. The waveguide of claim 9 further comprising a second lateral conductive material interconnecting the conductive materials on the upper and lower surfaces of the dielectric, the second lateral conductive material disposed on or near the first end surface of the dielectric, the first conductive excitation member located between the first and second lateral conductive members.

12. An electromagnetic waveguide component comprising:

a dielectric;

a conductive material on a first surface of the dielectric;

a ground plane on a second surface of the dielectric, the second surface opposite the first surface;

a conductive material on a first side surface of the dielectric interconnecting the ground plane and the conductive material on the first surface of the dielectric;

a conductive material on a second side surface of the dielectric interconnecting the ground plane and the conductive material on the first surface of the dielectric, the second side surface opposite the first side surface;

a first conductive excitation member disposed between the first and second surfaces of the dielectric on or near a first end surface of the dielectric, the first conductive excitation member electrically coupled to the conductive material disposed on the first surface of the dielectric, the first conductive excitation member having a first flange substantially coplanar with the ground plane, the first end surface of the dielectric devoid of conductive material on opposite sides of the first conductive excitation member, and a first portion of the dielectric separating and electrically isolating the first flange from the ground plane.

13. The waveguide of claim 12 is a transverse electric mode (TE) waveguide.

14. The waveguide of claim 12 further comprising a first lateral conductive material interconnecting the conductive material on the first surface of the dielectric and the ground plane, the first lateral conductive material disposed on or near the first end surface of the dielectric.

15. The waveguide of claim 14, wherein the first lateral conductive material is disposed on a first corner of the dielectric between the first end surface and the first or second side surface of the dielectric.

16. The waveguide of claim 14 further comprising a second lateral conductive material interconnecting the conductive material and the ground plane, the second lateral conductive material disposed on or near the first end surface, the first conductive excitation member located between the first and second lateral conductive materials, at least a portion of the first end surface devoid of conductive material between the first conductive excitation member and the first and second lateral conductive materials.

17. The waveguide of claim 14, wherein the first portion of the dielectric between the first flange and the ground plane is devoid of conductive material.

18. The waveguide of claim 14 further comprising:

a second conductive excitation member disposed between the first and second surfaces of the dielectric on or near a second end surface of the dielectric, the second conductive excitation member electrically coupled to the conductive material disposed on the first surface of the dielectric, the first conductive excitation member having a second flange substantially coplanar with the ground plane, the second end surface of the dielectric devoid of conductive material on opposite sides of the first conductive excitation member, and a second portion of the dielectric separating and electrically isolating the second flange from the ground plane.

19. The waveguide of claim 14 is a surface-mount component.

20. The waveguide of claim 14, the conductive material on each of the first and second side surfaces of the dielectric comprises one or more of a metallized slot, a metallized via, a metallized surface, or a metallized castellation.

* * * * *